United States Patent [19]

Dalencon

[11] 3,941,273

[45] Mar. 2, 1976

[54] BASKET FOR HANDLING MACHINE PARTS

[75] Inventor: André Dalencon, Paris, France

[73] Assignees: Regie Nationale des Usines Renault; Automobiles Peugeot, both of Billancourt, France

[22] Filed: Dec. 12, 1973

[21] Appl. No.: 426,665

[30] Foreign Application Priority Data

Dec. 12, 1972 France ..... 72.44149

[52] U.S. Cl. ..... 220/19; 211/41

[51] Int. Cl.[2] ..... B65D 7/20

[58] Field of Search ..... 150/48, 50, 51; 220/19; 211/41, 60 T, 60 S, 60 R

[56] References Cited

UNITED STATES PATENTS

| | | | |
|---|---|---|---|
| 974,199 | 11/1910 | Stark | 220/19 |
| 1,087,209 | 2/1914 | Blakeslee | 220/19 |
| 1,125,444 | 1/1915 | Barley | 220/19 |
| 2,667,262 | 1/1954 | Davis | 211/41 |
| 2,746,882 | 5/1956 | Hamal | 211/41 |
| 2,884,935 | 5/1959 | Fox | 211/41 |
| 2,979,323 | 4/1961 | Bixby | 220/19 |
| 3,016,148 | 1/1962 | Riddle | 211/41 |
| 3,017,232 | 1/1962 | Schwab | 211/41 |
| 3,410,546 | 11/1968 | Daringer | 220/19 |
| 3,433,363 | 3/1969 | Clearman | 211/41 |

*Primary Examiner*—William Price
*Assistant Examiner*—R. E. Hart
*Attorney, Agent, or Firm*—Oblon, Fisher, Spivak, McClelland & Maier

[57] ABSTRACT

The invention relates to a basket for handling delicate machine parts, such as gears in machine shops, which comprises a conventional outer body and an internal block forming a rack for separation and support of the parts. The internal block is made up of a stack of separator elements and support elements of molded plastic strung on threaded metal rods which pass through supporting bosses of the elements. The rods are clamped in position against one another by means of self-locking nuts.

4 Claims, 7 Drawing Figures

BASKET FOR HANDLING MACHINE PARTS

BACKGROUND OF THE INVENTION

1. Field of the Invention

The present invention relates generally to an article handling device and more particularly to a basket for handling machine parts.

1. Description of the Prior Art

Baskets of the character described herein generally consist of a conventional outer body and an internal block forming a rack for separation and support of the machine parts in a manner for holding them in place and preventing them from striking one another. They are particularly applicable to the handling of delicate parts such as gears in machine shops, which preferably should be held in a vertical orientation so as to take up as little space as possible in the basket, which will then accept the largest possible number.

Various embodiments of the internal block for such baskets are known, such as, for example, they are made of wood, with assembly being achieved by nailing or gluing, and thus they are difficult to modify. The base material of wood also makes these assemblies heavy and cumbersome, and in addition, being made by skilled labor, they are relatively expensive, while deteriorating rather rapidly.

Also known are embodiments composed of steel sheets or wires, of diverse and suitable forms, which may be assembled by riveting or soldering, and which thus also are difficult to modify. These also are heavy and their surfaces must be protected against rusting. They have the same disadvantages as wooden blocks with respect to cost, and further, the hardness of the metal presents the risk of damage to delicate features of the machine parts, such as to sharp corners thereon.

On the other hand, there are known embodiments formed of plastic material which are molded in one piece and which do not have these same disadvantages, but because of their multiple internal partitions, they require complex molding equipment, are thus of delicate construction, and consequently are rather costly. They can solve the problem of proximity of the parts. However, their one-piece design forces their complete replacement if any one of their elements is damaged by a blow or by the insertion of a part that is still hot.

SUMMARY OF THE INVENTION

Accordingly, it is an object of the present invention to provide a device for handling machine parts which is relatively easy to manufacture at a low cost and which is capable of storing the parts in a separated fashion therein such that they will not strike one another.

Another object of the present invention is to provide a device for handling machine parts which is relatively light in weight and which is not likely to damage the parts being handled or be damaged thereby when these parts are in a state of high temperature.

Still another object of this invention is to provide a basket for handling delicate machine parts by storing them in close but separated positions such that a large number of parts can be handled without fear of striking and damaging one another, and which is light in weight for easy handling and inexpensive to manufacture.

Yet a further object of the invention is to provide a basket for handling delicate machine parts which, if damaged, can be repaired by replacing only the damaged part thereof instead of requiring complete replacement of the internal block thereof.

The foregoing and other objects are achieved by the handling basket of the present invention which mitigates these several disadvantages. According to the present invention, the internal block of the basket consists of a stack of plastic separator elements clamped against one another by metal clamping rods passing through the supporting bosses of the elements. A block made in this manner forms a series of slots into which the parts to be stored may be inserted between elements preferably having the appearance of a perforated grill and being of an appropriate shape for wedging the parts therein. Being in the form of a grill, the elements can combine maximum strength with minimum weight through the use of plastic. The metal clamping rods are completely surrounded by plastic and therefore there is no danger of these rods coming into contact with the delicate machine parts, the only points of support being the plastic material.

The elements are preferably cast in symmetrical molds, the two halves of which meet in the bisecting plane of an element, and these are thus easily made by low-cost plastic injection molding techniques.

Damaged elements may thus be readily replaced without having to change the rest of the assembly. An additional feature is that different types of elements suited to hold different parts can be used in the same outer body.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts throughout the several views, and in which.

DETAILED DESCRIPTION OF THE ILLUSTRATED EMBODIMENTS

Figure 1:
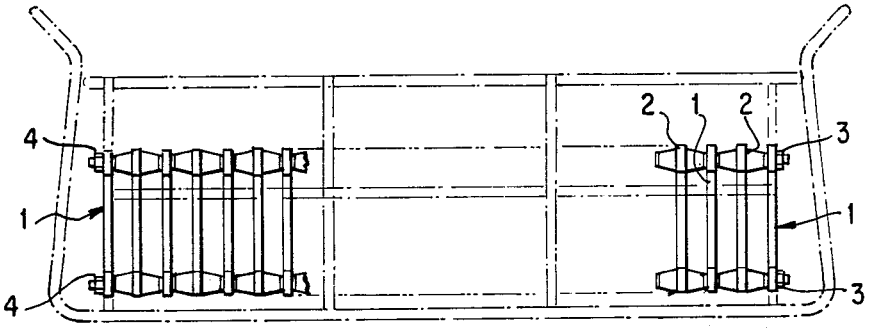
FIG. 1 is a side view of a basket according to this invention.

Referring now to the drawings, and particularly to FIG. 1, the outer body of the basket is shown in phantom as are also the differently shaped parts secured therewithin. The internal block consists of a stack of successively arranged separator elements 1 and support elements 2, both being preferably made of a plastic material, mounted on metal clamping rods 3 which pass through supporting bosses on these elements. The clamping rods are clamped in position one against another by means of self-locking units 4 and the assembly is made so that there is a separator element 1 at each end of the stack.

Figure 2:
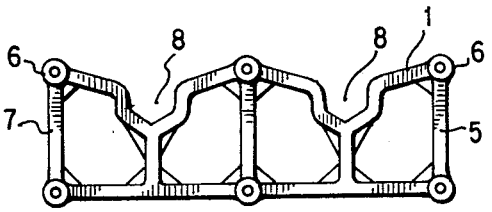
FIG. 2 is a side view of a separator element for the basket according to this invention.
Figure 3:
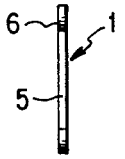
FIG. 3 is an end view of the separator element shown in FIG. 2.

In FIGS. 2 and 3, there is shown a separator element 1 for an internal block intended to hold two parallel rows of parts, such as, for example, gears. The body 5 of the element has a profile making it easy to remove from a mold, the two halves of which join along the bisecting plane, except at the locations of flat bosses 6. Small flat gussets 7, located in the angles, give the assembly rigidity. The upper section of the body 5 has two dips 8, one per row of parts, intended to make it easier to hold objects in the basket.

Figure 4:
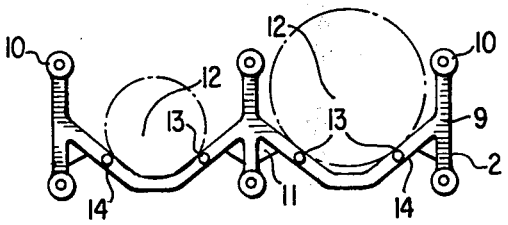
FIG. 4 is a side view of a supporting element for the basket of this invention.
Figure 5:
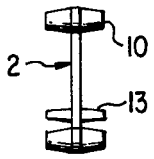
FIG. 5 is an end view of the supporting element shown in FIG. 4.

FIGS. 4 and 5 show a support element 2 for an internal block intended to hold two parallel rows of parts. The body 9 of the element also has a profile for easy removal from the mold, bosses 10 being located symmetrically on the two sides of the body 8 and being conical, which also facilitates removal. In addition, the bosses 10 are of a thickness to form slots for receiving the parts. Small flat gussets 11 located at the angles subjected to greater stress serve to give the assembly rigidity. The body 9 of the element has two dips 12, one per row of parts, shaped approximately like an open V, on which small parts rest. An extra boss 13 located at mid-height on the arms of each V in order to support larger machine parts. These bosses 13 are, just as bosses 10, conical in shape, and are symmetrically situated on the two sides of body 9 and are slightly longer than the bosses 10 so that they can extend into the interior of the separator elements 1. They are reinforced underneath by small flat gussets 14 of a form suitable for resisting flexure and facilitating removal from the mold.

Figure 6:
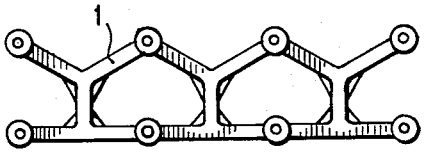
FIG. 6 is a side view of a modified embodiment of the separator element shown in FIGS. 2 and 3.

FIG. 6 shows a separator element 1' for an internal block intended to hold three parallel rows of machine parts. In function and constitution, this element 1' is similar to that of the element 1 described in FIGS. 2 and 3.

Figure 7:
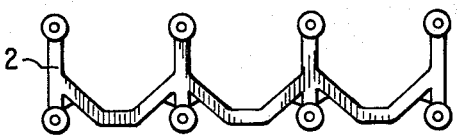
FIG. 7 is a side view of a modified embodiment of the supporting element shown in FIGS. 4 and 5.

FIG. 7 shows a corresponding support element 2' for an internal block intended to hold three parallel rows of machine parts. In function and constitution, this element 2' is similar to that of the element 2 described in FIGS. 4 and 5.

Thus, it may be seen that a basket is provided, which is easy and inexpensive to manufacture, for holding a plurality of machine parts in close proximity, yet without permitting the parts to strike one another and to thereby cause damage. Because of the construction, the parts are firmly held and elements of the basket are replaceable if necessary without replacing the entire assembly.

Obviously, many modifications and variations are possible in light of these teachings. It is therefore to be understood that within the scope of the appended claims, the invention may be practiced otherwise than as specifically described herein.

What is claimed as new and desired to be secured by letters patent of the United States is:

1. A basket for handling heavy machine parts having an outer body and an internal block forming a rack for separation and support of said part while holding them fixed in position and preventing them from striking one another, the improvement characterized by said internal block comprising:

a plurality of transversely extending wall-type separator elements composed of a plastic material and each having a lower transversely extending section, an upper transversely extending section, a plurality of vertically extending sections connecting said upper and lower sections, and a plurality of flat supporting bosses formed on each of said upper and lower sections at the ends thereof and at least at one intermediate point;

a plurality of transversely extending support elements composed of a plastic material and each having a plurality of vertically extending sections, a lower transversely extending section connected between each adjacent pair of vertically extending sections, said lower sections being of substantially an open V configuration, a plurality of first longitudinally extending supporting bosses formed on each of said vertically extending sections at the upper and lower ends thereof, and a plurality of additional longitudinally extending supporting bosses formed on said lower sections being of slightly greater longitudinal extension than said first bosses; and a plurality of metal clamping rods passing through said flat and said first longitudinally extending supporting bosses on said separator and support elements, respectively, for clamping said separator and support elements against one another, said separator and support elements being arranged longitudinally in an alternating fashion so as to define storage cavities between each adjacent pair of separator elements;

said heavy machine parts being able to be respectively disposed within said storage cavities and separated from each other by said separator elements while being supported upon said support elements in such a manner that peripheral portions of said machine parts are able to be supported upon said support elements while front and rear surface portions of said parts are able to be supported by said separator elements.

2. A handling basket as set forth in claim 1, wherein said bosses for supporting parts and those for assembly of the block are integral with the support elements and form the points of support of said machine parts.

3. A handling basket as set forth in claim 1, wherein said separator elements have dips in the upper sections thereof facilitating holding of the parts.

4. A handling basket as set forth in claim 1, wherein said separator and support elements clamped together by said metal clamping rods have the form of a perforated grill.

* * * * *